United States Patent [19]

Thuries

[11] Patent Number: 4,983,789

[45] Date of Patent: Jan. 8, 1991

[54] HIGH- AND MEDIUM-VOLTAGE GAS CIRCUIT BREAKERS

[75] Inventor: Edmond Thuries, Meyzieu, France

[73] Assignee: GEC Alsthom SA, Paris, France

[21] Appl. No.: 459,893

[22] Filed: Jan. 2, 1990

[30] Foreign Application Priority Data

Jan. 2, 1989 [FR] France ..... 89 00009

[51] Int. Cl.[5] ..... H01H 33/88

[52] U.S. Cl. ..... 200/148 A; 200/148 R

[58] Field of Search ..... 200/148 A

[56] References Cited

U.S. PATENT DOCUMENTS

| | | | |
|---|---|---|---|
| 2,957,063 | 10/1960 | Leeds | 200/148 A |
| 4,650,942 | 3/1987 | Perret | 200/148 A |
| 4,754,109 | 6/1988 | Thuries et al. | 200/148 A |
| 4,774,388 | 9/1988 | Thuries et al. | 200/148 A |

FOREIGN PATENT DOCUMENTS 3132825 1/1983 Fed. Rep. of Germany .

2576142 7/1986 France .

*Primary Examiner*—Robert S. Macon

*Attorney, Agent, or Firm*—Sughrue, Mion, Zinn, Macpeak and Seas

[57] ABSTRACT

A high- and medium-voltage gas circuit breaker comprises a cylindrical electrically insulative enclosure filled with dielectric gas under pressure, a fixed main contact and a fixed arc contact. A mobile assembly is coupled to an operating member and comprises a mobile main contact, a mobile arc contact and a blow-out cylinder associated with a blow-out nozzle and cooperating with a first piston. A second piston is fastened to the mobile assembly and slides in a fixed second cylinder. The second piston has a large cross-section in relation to the cross-section of the blow-out cylinder. The second piston is associated with a system for providing low head loss communication with the arc area and comprises orifices of calibrated size to limit the pressure on the face of the piston on which the gas heated by the arc impinges.

5 Claims, 2 Drawing Sheets

HIGH- AND MEDIUM-VOLTAGE GAS CIRCUIT BREAKERS

BACKGROUND OF THE INVENTION

1. Field of the invention

The present invention concerns high-voltage and medium-voltage circuit breakers using a dielectric gas such as sulfur hexafluoride at a pressure of a few bars.

2. Description of the prior art

The invention is more particularly directed to a circuit breaker of the aforementioned type in which the increased pressure due to the appearance of an electric arc between the arc contacts at the time of tripping is exploited to apply a motive force to the mobile assembly; this arrangement, which is known, for example, from French patent No. 2 576 142, enables the arc to be extinguished without using an excessively high powered operating device.

In so-called low operating energy circuit breakers the increased pressure that originates near the arc propagates to the piston coupled to the mobile assembly.

The ease and speed with which the pressure is propagated depend partly on the obstacles to the flow of gas between the arc area and the piston and partly on the changing pressure gradient between the arc area and the face of the piston.

In known devices, for example as disclosed in the German published patent application DE 31 32825 A1 or in U.S. Pat. No. 2 957 063, the gas propagates in annular conduits the narrow cross-section of which is not favorable to high-speed flow; what is more, the pressure gradient between the arc area and the face of the piston decreases very rapidly so that the mechanical action of the gas is very soon attenuated after the arc appears.

One object of the invention is to provide a circuit breaker in which the pressure is rapidly transmitted to the piston coupled to the operating member and in which the flow of gas from the arc area occurs at high speed and without disturbance.

SUMMARY OF THE INVENTION

The invention consists in a high-voltage or medium-voltage gas circuit breaker comprising a cylindrical electrically insulative casing adapted to be filled with dielectric gas under pressure, a fixed main contact, a fixed arc contact, a mobile assembly adapted to be coupled to an operating member and comprising a mobile main contact, a mobile arc contact and a blow-out cylinder associated with a blow-out nozzle and cooperating with a first piston, and a second piston fastened to the mobile assembly and sliding in a fixed second cylinder, characterized in that said second piston has a large cross-section in relation to the crosssection of the blow-out cylinder, is associated with means for providing low head loss communication with the arc area and comprises orifices of calibrated size to limit the pressure on the face of said piston on which the gas heated by the arc impinges.

In one preferred embodiment the arc contact comprises a first end of a metal tube coaxial with the circuit breaker, the second end of said tube is adapted to be coupled to said operating member, said second piston is an annular piston outside said tube and fastened to it, said low head loss communication means are constituted by said tube which comprises wide openings at its periphery and the interior of said tube is closed substantially in line with said piston by a closure member.

The invention will now be explained with reference to the appended drawings.

DETAILED DESCRIPTION OF THE INVENTION

Figure 1:
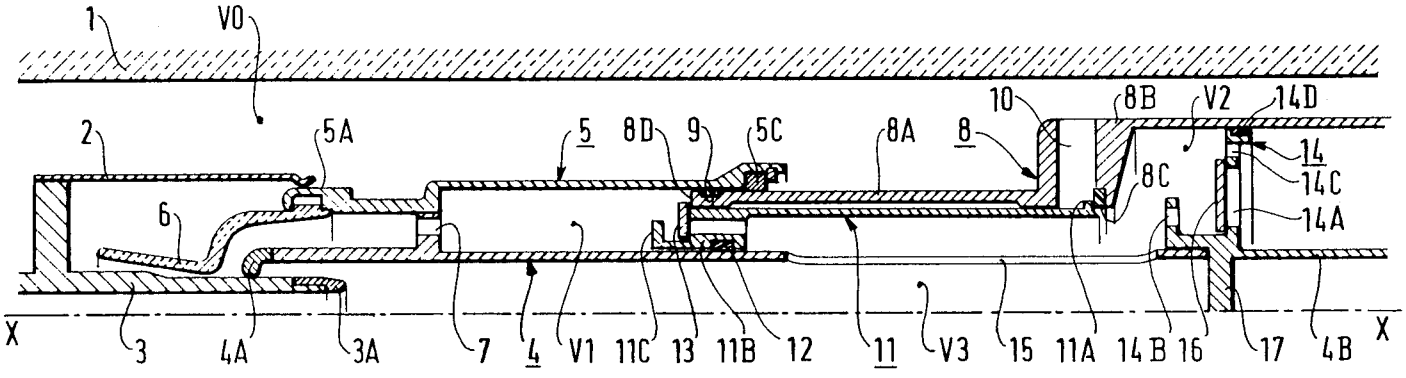
FIG. 1 is a partial view in axial half-section of a circuit breaker in accordance with the invention, shown in the closed position.

The circuit breaker, part of which is shown in FIG. 1, comprises a casing 1 of an insulative material such as ceramic, of generally cylindrical shape with an axis XX and delimiting an interior volume Vo filled with dielectric gas such as sulfur hexafluoride at a pressure of a few bars.

The circuit breaker comprises a fixed main contact 2 connected to a first terminal (not shown) and a fixed arc contact 3 having one end 3A made from an arc resistant alloy such as an alloy of tungsten.

The mobile assembly of the circuit breaker comprises a tube 4 which has one end 4A made from an arc resistant alloy and constituting the mobile arc contact. The other end 4B of the tube 4 is coupled to an operating device (not shown). The tube 4 is fastened to a tube 5 of which one end 5A constitutes the mobile main contact of the circuit breaker.

Fixed to the end 5A is an insulative nozzle 6 the neck of which is obstructed by the arc contact 4 when the circuit breaker is closed.

Holes 7 are formed in the ring joining the tubes 4 and 5 so that these tubes define a common single volume V1 closed on one side by the nozzle 6.

The tube 5 is guided by a tubular first part 8A of a fixed metal member 8 having a tubular second part 8B the diameter of which is much larger than that of the part 8A.

The member 8 is connected to a second terminal (not shown).

The tube 5 carries a sliding electrical contact 5C cooperating with the tube 8A.

In the closed position of the circuit breaker the current flows through the parts 2, 5, 8. A seal 9 is provided between the tubes 5 and 8A.

The tubes 8A and 8B are joined by a solid portion of the member 8 which comprises radial openings 10. The openings 10 are normally closed by a slide 11 one annular end 11A of which cooperates with a circular seal 8C at their base. This end 11A serves also to limit the travel of the slide by coming into abutting relationship with the base of the openings 10 opposite the seal 8C. The slide 11 is generally tubular; it has a tubular portion 11B which can slide on the tube 4 which guides it.

A seal 12 is provided. The slide 11 is also guided by the fixed member 8A which includes an appropriate boss 8D.

The annular space between the tubes 11 and 11B is selectively closed by an annular valve 13 the travel of which is limited by a flange 11C on the part 11B.

The tube 5 constitutes the blow-out cylinder of the circuit breaker. It is fastened to a piston 14 inside the tube 8B inside which it can slide in a fluid-tight way by virtue of a seal 14D. The piston 15 and the tubes 8A and 8B delimit a volume V2. The piston comprises openings 14A selectively closed by an annular valve 16 the travel of which is limited by a flange 14B.

A fundamental characteristic of the invention is that the cross-section of the piston is large in comparison with the cross-section of the blow-out cylinder. For example, the ratio of their diameters is at least 2:1.

The piston 14 also comprises calibrated openings 14C the function of which will be described later.

The tube 4 comprises very large openings 15 on its surface establishing communication through very large cross-section passageways between the volume V2 and the volume V3 inside the tube 5. Note that the volume V3 is closed at the operating member end by a disk 17 fastened to the tube 4.

The circuit breaker operates in the following manner:

1) Interrupting high currents (short-circuits)

When a short-circuit is detected the operating device of the circuit breaker moves the mobile assembly (tubes 4 and 5, nozzle 6, piston 14) towards the right as seen in the figure.

The main contacts are separated and the current then flows through the arc contacts 3 and 4.

Figure 2:
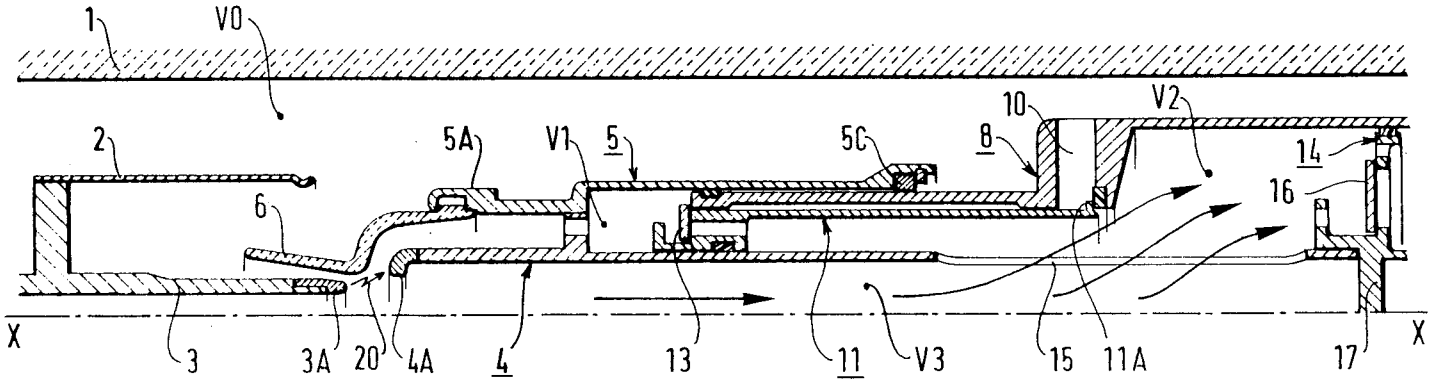
FIG. 2 is a partial view in axial half-section of the same circuit breaker shown during opening (tripping out).

When the arc contacts are separated an arc 20 forms (FIG. 2); it heats the surrounding gas and the pressure rises sharply. The volume V1 is closed by the valve 13. The hot gas escapes via the volume V3 around the axis and passes into the volume V2 through the openings 15.

As the surface area of the piston is very large the force exerted on it to assist with the opening maneuver is high.

The flow of the hot gas from the arc area is facilitated by:

a) the large openings 15 which eliminate head losses, and b) the calibrated orifices 14C which limit the pressure in the volume V2, so ensuring a pressure gradient between the arc area and the area of the piston 14.

The first time the current passes through zero the pressure in the volume V1 causes gas to expand through the nozzle 6, extinguishing the arc.

2) Interrupting low currents (nominal current, capacitive current or low inductive current)

When the arc contacts are separated the increased pressure due to the arc is insufficient to apply the valve 16 to its seat. The valve remains open and this avoids any pressure reduction in the volume V2 which would otherwise retard the mobile assembly.

The pressure in the volume V1 is sufficient to apply the valve 13 to its seat. The pressure drop in the volume V1 when the current passes through zero is sufficient to extinguish the arc.

3) Closing the circuit breaker

Figure 3:
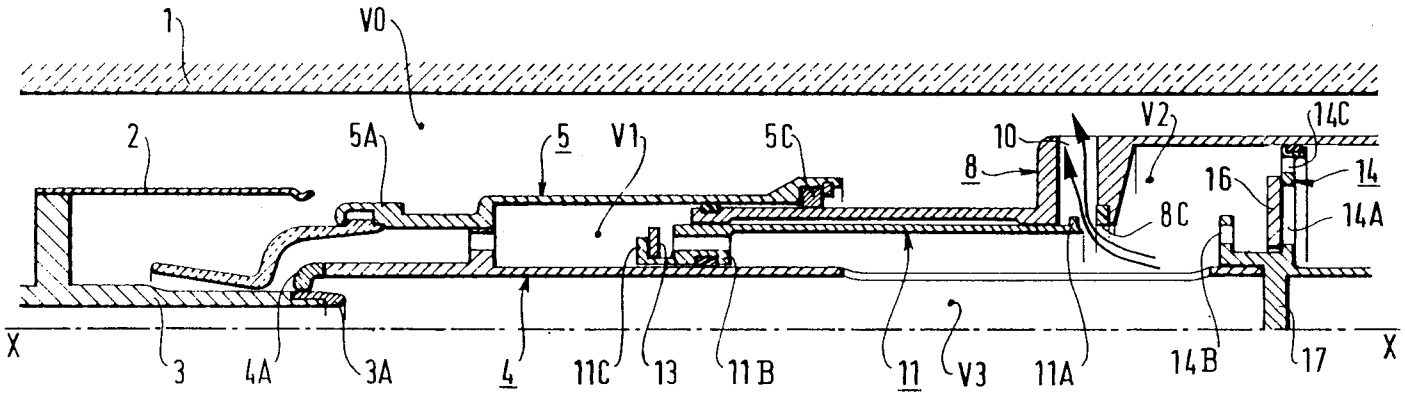
FIG. 3 is a partial view in axial half-section of the same circuit breaker during closing.

Refer to FIG. 3.

The operating member moves the mobile assembly towards the right as seen in the figure. A slight rise in pressure in volume V2 closes the valve 16 and, in conjunction with a slight drop in pressure in the volume V1, causes the slide 11 to move to the left.

This uncovers the base of the openings 10, enabling the gas from the volume V2 to escape towards the volume Vo, and avoids a loss of energy due to compression of the gas.

The valve 13 is opened, which enables the volume V1 to be filled without any special provisions being made, because of a large drop in pressure in the volume V1.

The energy required to operate the circuit breaker that has just been described is very much less than that for prior art circuit breakers.

The invention applies to high- and medium-voltage circuit breakers.

There is claimed:

1. High- and medium-voltage gas circuit breaker comprising a cylindrical electrically insulative casing adapted to be filled with dielectric gas under pressure, a fixed main contact, a fixed arc contact, a mobile assembly adapted to be coupled to an operating member and comprising a mobile main contact, a mobile arc contact and a blow-out cylinder associated with a blow-out nozzle and cooperating with a first piston, a second piston fastened to said mobile assembly and a fixed second cylinder in which said second piston slides, wherein said second piston has a large cross-section in relation to the cross-section of said blow-out cylinder, is associated with means for providing low head loss communication with the arc area and comprises orifices of calibrated size to limit the pressure on the face of said piston on which the gas heated by the arc impinges.

2. Circuit breaker according to claim 1 wherein said arc contact comprises a first end of a metal tube coaxial with the circuit breaker and wherein the second end of said tube is adapted to be coupled to said operating member, said second piston is an annular piston outside said tube and fastened to it, said low head loss communication means are constituted by said tube which comprises wide openings at its periphery and the interior of said tube is closed substantially in line with said piston by a closure member.

3. Circuit breaker according to claim 2 wherein said first piston comprises an annular valve closing a cylindrical slide coaxial with and external to said tube, and said slide is adapted to assume two positions in which it covers or uncovers openings in said second cylinder discharging into the volume contiguous with said casing.

4. Circuit breaker according to claim 3 wherein said openings are radial openings.

5. Circuit breaker according to claim 1 wherein said second piston carries a valve constrained to be closed when the pressure on the face of said second piston on the same side as said arc area is higher than the pressure on the other side.

* * * * *